US011629828B2

(12) United States Patent
Kuo

(10) Patent No.: US 11,629,828 B2
(45) Date of Patent: Apr. 18, 2023

(54) RECESSED LIGHT AND LAMPSHADE THEREOF

(71) Applicant: Shuang-Ju Tsai, Taichung (TW)

(72) Inventor: Ren-Hau Kuo, Taichung (TW)

(73) Assignee: Shuang-Ju Tsai, Taichung (TW)

( * ) Notice: Subject to any disclaimer, the term of this patent is extended or adjusted under 35 U.S.C. 154(b) by 0 days.

(21) Appl. No.: 17/860,578

(22) Filed: Jul. 8, 2022

(65) Prior Publication Data

US 2023/0051870 A1 Feb. 16, 2023

(30) Foreign Application Priority Data

Aug. 10, 2021 (TW) ..... 110129513

(51) Int. Cl.
*F21S 8/02* (2006.01)
*F21V 1/12* (2006.01)
*F21V 17/10* (2006.01)

(52) U.S. Cl.
CPC ..... *F21S 8/026* (2013.01); *F21V 1/12* (2013.01); *F21V 17/104* (2013.01)

(58) Field of Classification Search
CPC ..... F21V 17/104; F21S 8/026
See application file for complete search history.

(56) References Cited

U.S. PATENT DOCUMENTS 11,221,124 B1* 1/2022 Ryan ..... F21V 1/10
2012/0087132 A1* 4/2012 Zakula ..... F21V 15/02 362/373
2012/0182734 A1* 7/2012 Shimizu ..... F21S 8/026 362/249.02
2012/0300473 A1* 11/2012 Fu ..... F21V 17/002 362/351
2015/0184869 A1* 7/2015 Lin ..... F21S 8/026 362/96
2016/0375169 A1* 12/2016 Hsiao ..... F21V 33/0028 362/92
2017/0059102 A1* 3/2017 Grant ..... F21S 8/026
2018/0051861 A1* 2/2018 Dhillon ..... F21V 17/16
2018/0224092 A1* 8/2018 Hsieh ..... F21V 1/14
2019/0242123 A1* 8/2019 Kouijzer ..... F21V 7/0041
2021/0262650 A1* 8/2021 Danesh ..... F21V 17/164
2022/0307659 A1* 9/2022 Cohen ..... F21V 23/04

* cited by examiner

*Primary Examiner* — Jong-Suk (James) Lee
*Assistant Examiner* — Christopher E Dunay
(74) *Attorney, Agent, or Firm* — Muncy Geissler Olds & Lowe P.C.

(57) ABSTRACT

A recessed light and a lampshade thereof are provided. The lampshade includes: a shade body, including a cover member and a top plate covered on the cover member, the top plate including a notch, the notch being open at a periphery of the top plate, the shade body further including a slot, the slot being in communication with the notch, the slot having a width larger than a width of the notch, the diametric dimension of the flange being larger than the width of the notch; wherein the slot is configured to receive the flange, the notch is configured to receive the body portion, and the top plate is configured to be engaged between the substrate and the flange.

9 Claims, 8 Drawing Sheets

RECESSED LIGHT AND LAMPSHADE THEREOF

BACKGROUND OF THE INVENTION

Field of the Invention

The present invention relates to a recessed light and a lampshade thereof.

Description of the Prior Art

Indoor lamps may be generally classified into direct lighting and indirect lighting. The indirect lighting is soft and not dazzling, but it is easy to accumulate dust and the cost is relatively high. In direct lighting, the LED lamp is relatively cheap and affordable, but its disadvantage is relatively more dazzling. When the user looks directly at the ceiling, the eyes will be uncomfortable due to the strong light, and there will even be a situation where the strong light is temporarily lingering. Furthermore, children often stare directly at the ceiling, and the strong light can result in an adverse effect on the developing children's eyes.

The present invention is, therefore, arisen to obviate or at least mitigate the above-mentioned disadvantages.

SUMMARY OF THE INVENTION

The main object of the present invention is to provide a recessed light and a lampshade thereof, which simplifies installation/uninstallation, makes the light soft and not dazzling, and allows compatibility of various shapes of lampshade.

To achieve the above and other objects, a lampshade of a recessed light is provided, the lampshade being configured to be connected to a base, the base including a substrate and a lamp, the lamp being disposed on the substrate and including a body portion and a flange, the body portion being disposed on the substrate, the substrate having a diametric dimension larger than a diametric dimension of the flange, the diametric dimension of the flange being larger than a diametric dimension of the body portion, the lampshade including: a shade body, including a cover member and a top plate covered on the cover member, the top plate including a notch, the notch being open at a periphery of the top plate, the shade body further including a slot, the slot being in communication with the notch, the slot having a width larger than a width of the notch, the diametric dimension of the flange being larger than the width of the notch; wherein the slot is configured to receive the flange, the notch is configured to receive the body portion, and the top plate is configured to be engaged between the substrate and the flange.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
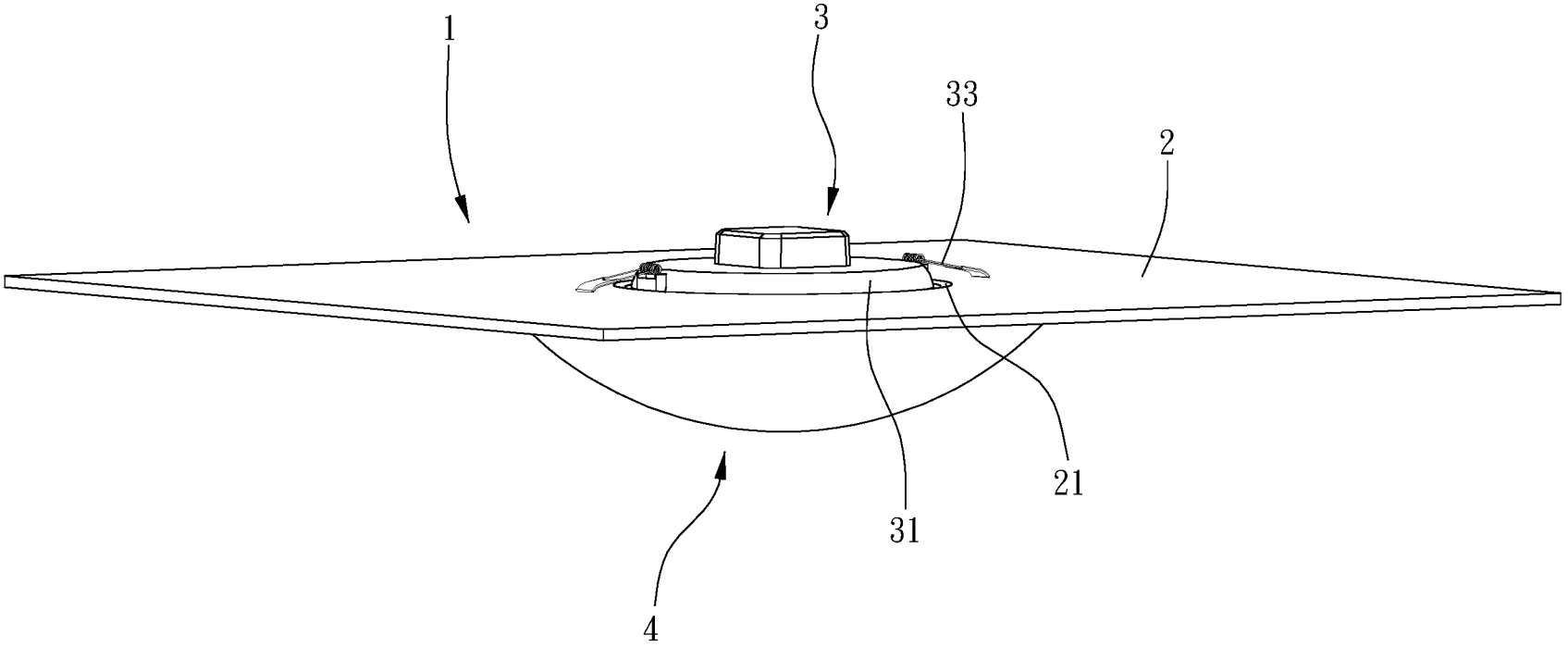
FIG. 1 is a stereogram of a preferable embodiment of the present invention.
Figure 2:
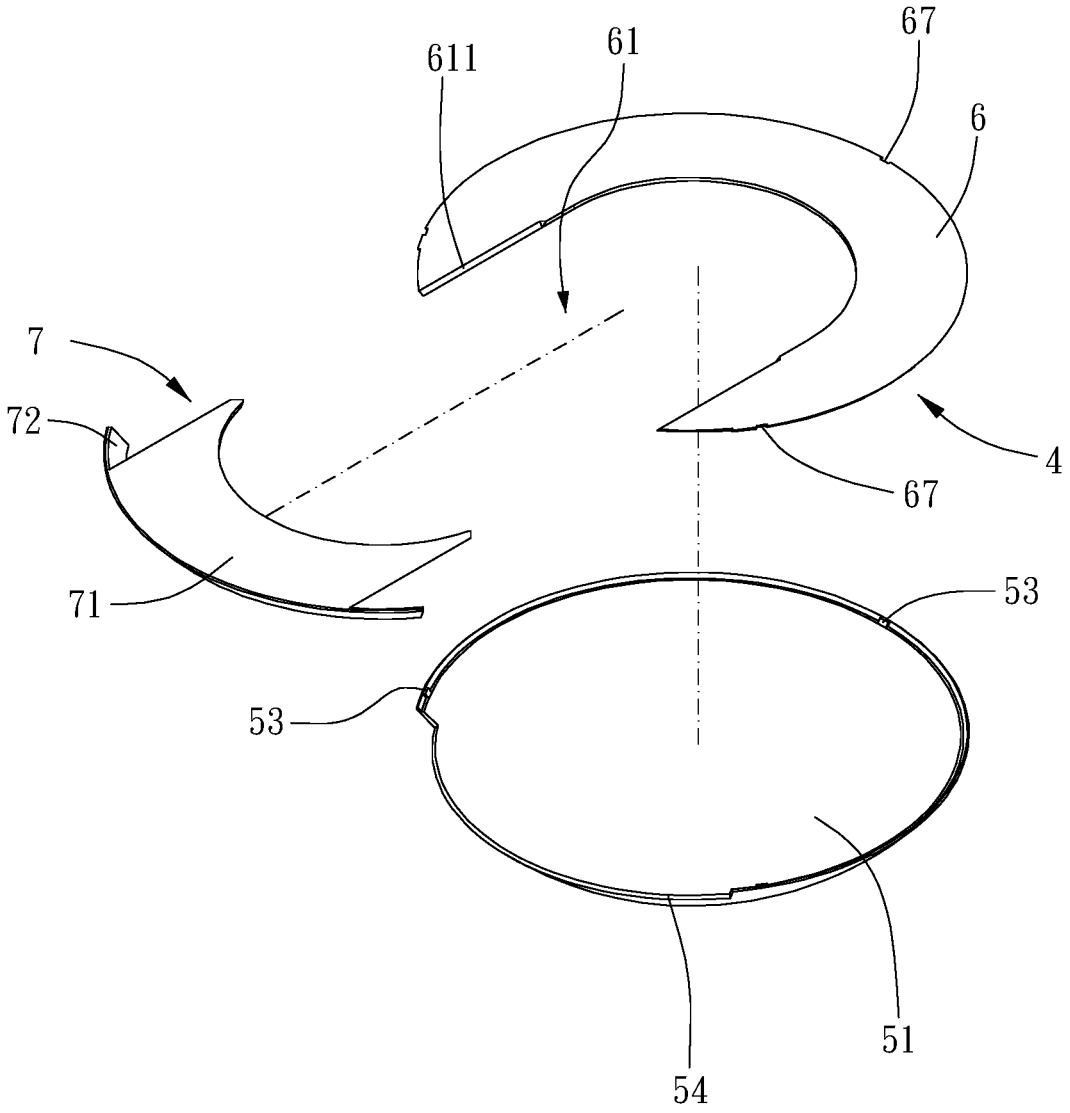
FIGS. 2 and 3 are breakdown drawings of a lampshade according to a preferable embodiment of the present invention.
Figure 3:
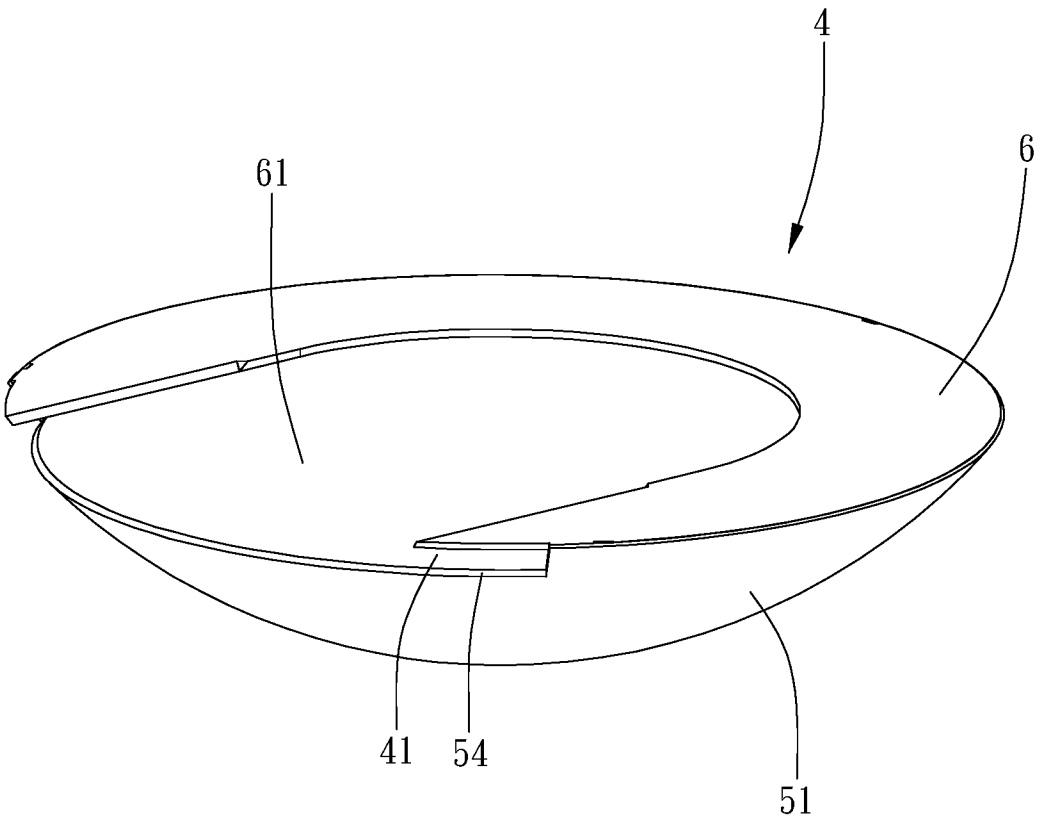
Figure 4:
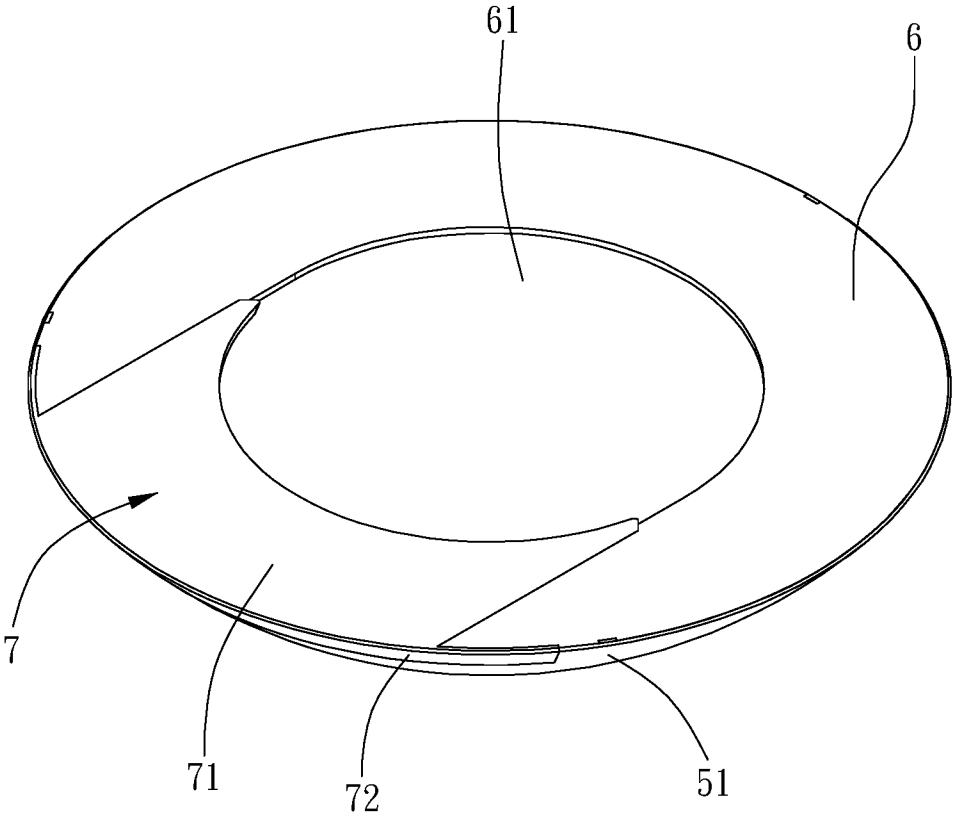
FIG. 4 is a stereogram of the lampshade according to a preferable embodiment of the present invention.
Figure 5:
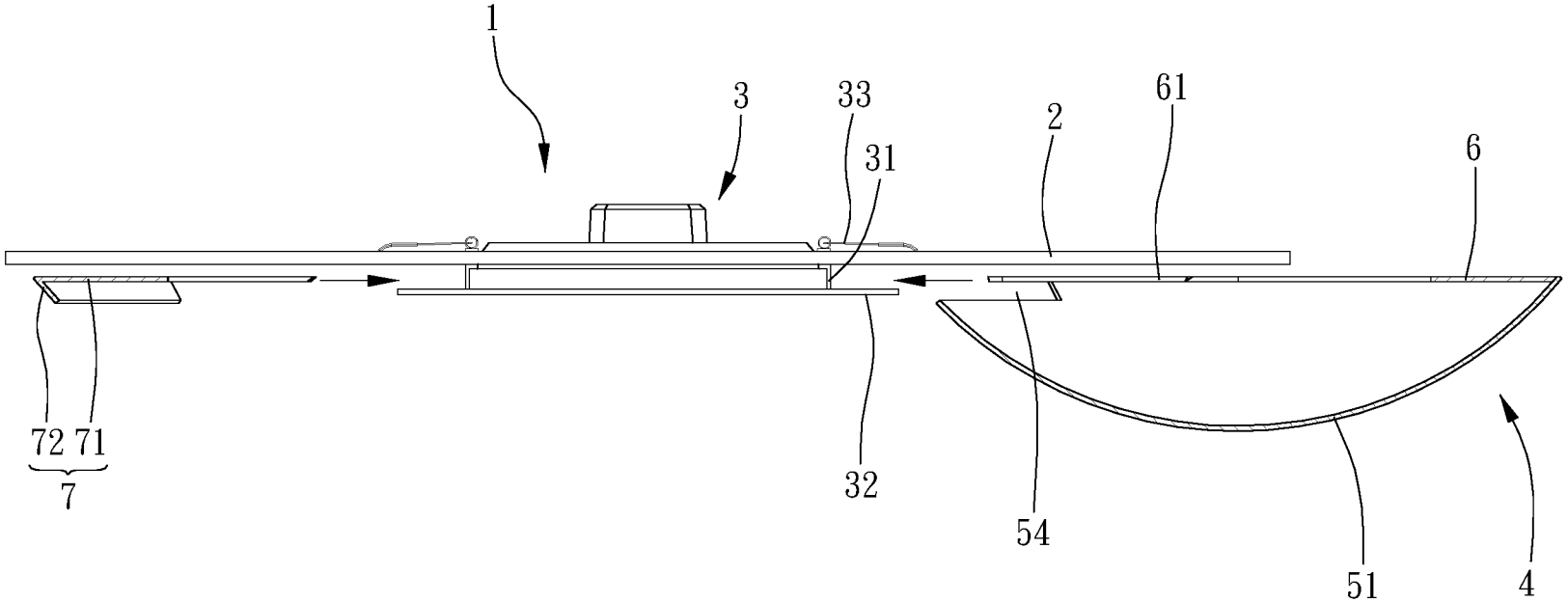
FIGS. 5 and 6 are drawings showing installation of a preferable embodiment of the present invention.
Figure 6:
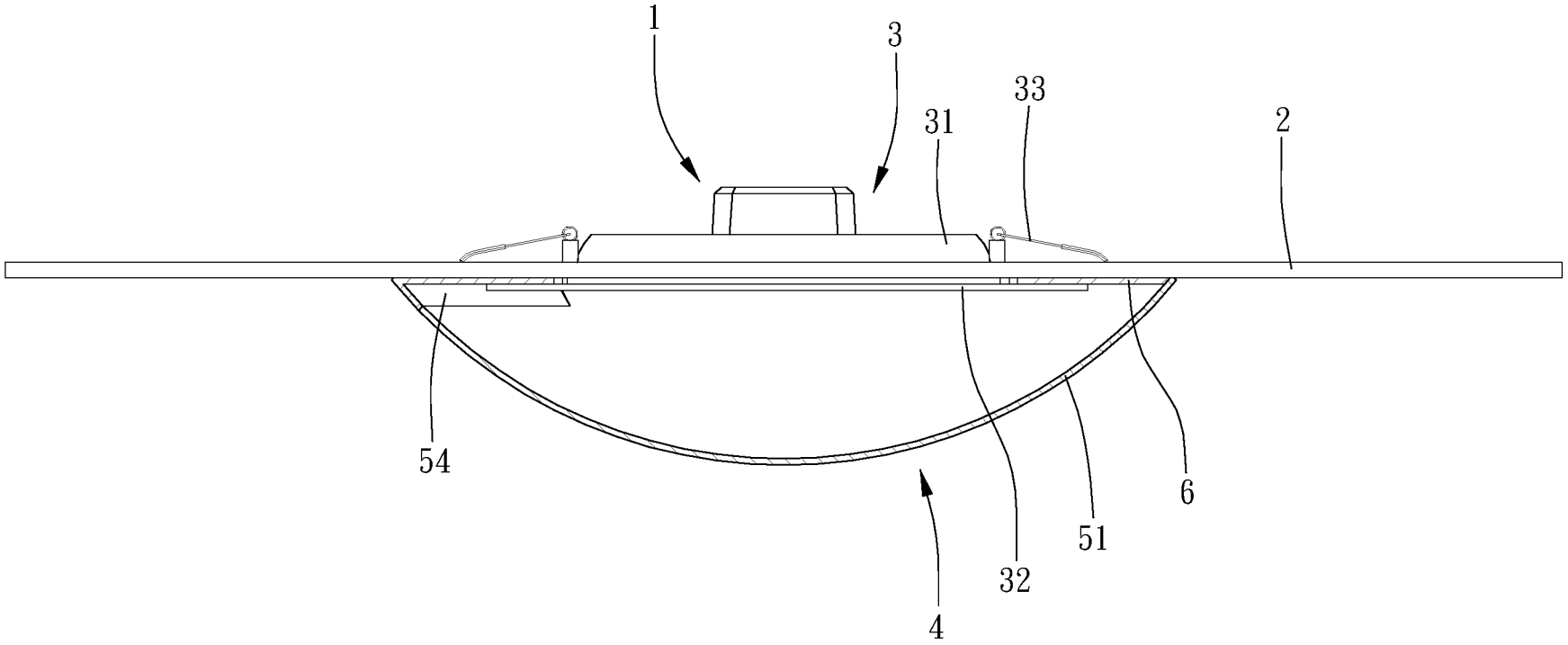
Figure 7:
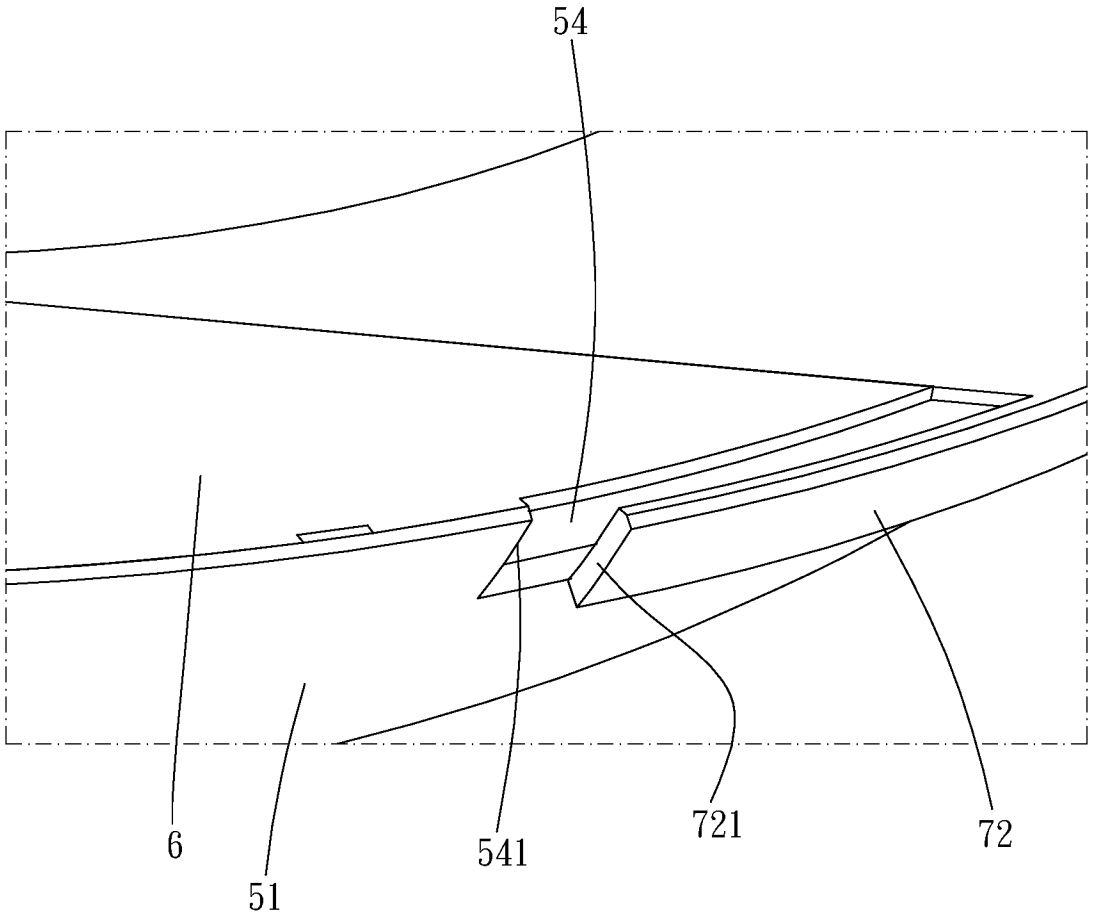
FIG. 7 is a partial enlargement of a preferable embodiment of the present invention.
Figure 8:
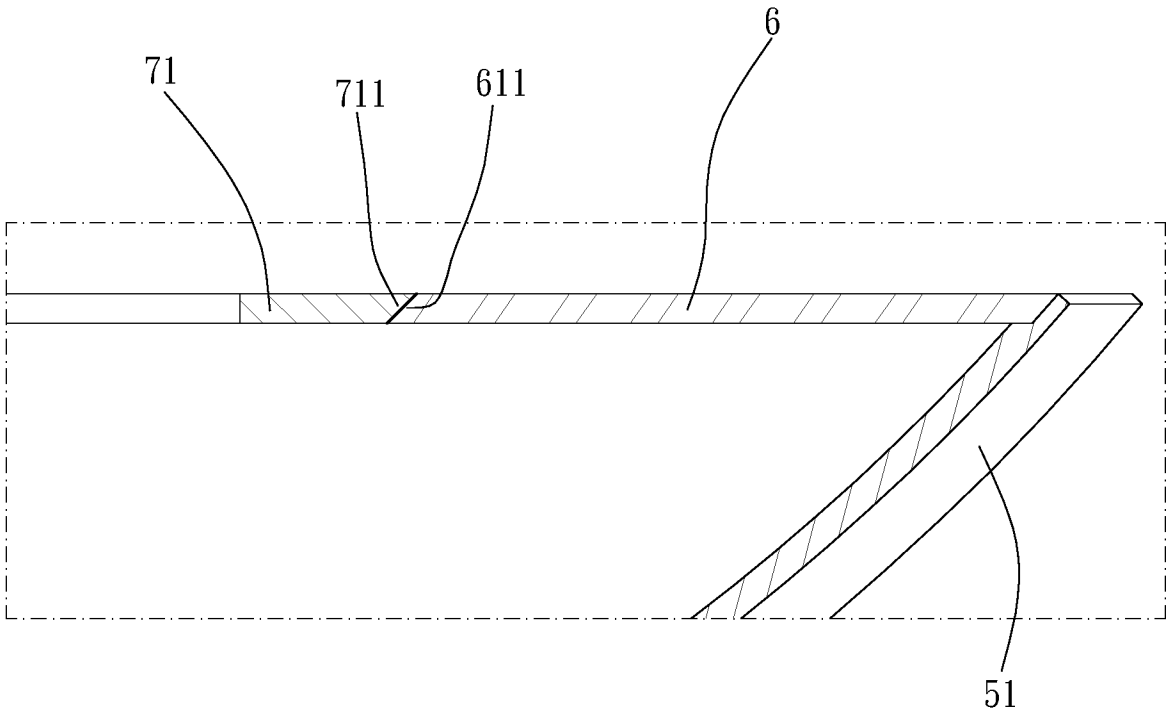
FIG. 8 is a partial cross-sectional view of a preferable embodiment of the present invention.

Please refer to FIGS. 1 to 8 for a preferable embodiment of the present invention. A lampshade of a recessed light of the present invention is configured to be connected to a base 1, the base 1 includes a substrate 2 and a lamp 3, the lamp 3 is disposed on the substrate 2 and includes a body portion 31 and a flange 32, the body portion 31 is disposed on the substrate 2, the substrate 2 has a diametric dimension larger than a diametric dimension of the flange 32, the diametric dimension of the flange 32 is larger than a diametric dimension of the body portion 31, and the lampshade includes a shade body 4.

The shade body 4 includes a cover member 51 and a top plate 6 covered on the cover member 51, the top plate 6 includes a notch 61, the notch 61 is open at a periphery of the top plate 6, the shade body 4 further includes a slot 41, the slot 41 is in communication with the notch 61, the slot 41 has a width larger than a width of the notch 61, and the diametric dimension of the flange 32 is larger than the width of the notch 61.

The slot 41 is configured to receive the flange 32, the notch 61 is configured to receive the body portion 31, and the top plate 6 is configured to be engaged between the substrate 2 and the flange 32.

The present invention further provides a recessed light. The recessed light includes the lampshade, and further includes a base 1, the base 1 includes a substrate 2 and a lamp 3, the lamp 3 is disposed on the substrate 2 and includes a body portion 31 and a flange 32, the body portion 31 is disposed on the substrate 2, the substrate 2 has a diametric dimension larger than the diametric dimension of the flange 32, and the diametric dimension of the flange 32 is larger than the diametric dimension of the body portion 31.

The shade body 4 makes the light of the lamp 3 soft and not dazzling; the lamp 3 is installed through detachably inserting the flange 32 in the slot 41, and the top plate 6 is positioned between the substrate 2 and the flange 32, so that it is easy and quick to install/uninstall; and the substrate 2 can be installed with various shapes of lampshade, which reduces the production cost.

Specifically, the cover member 51 includes a recess 54 open toward the top plate 6, and the recess 54 and the top plate 6 define the slot 41. In other embodiments, the slot 41 may be disposed directly on the top plate 6 or the cover member 51.

In this embodiment, further includes a blocking member 7, the blocking member 7 includes an upper plate 71 and a lower plate 72 connected to each other, the upper plate 71 is inserted within the notch 61, and the lower plate 72 is inserted within the slot 41, so that the base 1 can be blocked, and the shade body 4 is prevented from disengaging from the body portion 31 and the flange 32.

The upper plate 71 has a width smaller than a width of the lower plate 72, the lower plate 72 is curved and of a profile matching with a profile of the recess 54, a closed end of the notch 61 is concave, and an end of the blocking member 7 remote from the notch 61 is convex. After the lower plate 72 is inserted within the slot 41, the blocking member 7 is not protrusive beyond the cover member 51 and the top plate 6, and the blocking member 7 and the top plate 6 form a circular plate.

Two sides of the lower plate 72 each include an abutting end 721 abutted against one of two sidewalls 541 of the recess 54, thus reinforcing the combination. Preferably, two sides of the upper plate 71 each include a first inclined surface 711, and two sides of the notch 61 each include a second inclined surface 611 abutted against the first inclined surface 711, wherein the two second inclined surfaces 611 can support the upper plate 71 and prevent the upper plate 71 from bending downward.

Specifically, the cover member 51 is bowl-shaped, the top plate 6 has an outer diametric dimension equal to an inner diametric dimension of the cover member 51, and the top plate 6 is detachably engaged within the cover member 51, so that it is simple in structure. In this embodiment, a plurality of protrusions 53 are disposed on one of the top plate 6 and the cover member 51, a plurality of concaves 67 are disposed on the other of the top plate 6 and the cover member 51, and the plurality of protrusions 53 are engaged with the plurality of concaves 67, respectively. As such, the top plate 6 and the cover member 51 are easy to align to each other, and the top plate 6 and the cover member 51 can be stably engaged with each other.

In this embodiment, the substrate 2 includes a through hole 21, the body portion 31 is disposed through the through hole 21, the diametric dimension of the flange 32 is larger than a diametric dimension of the through hole 21, so that the flange 32 cannot move through the through hole 21.

The body portion 31 is slidable relative to the through hole 21, the lamp 3 includes at least one elastic engaging member 33, and the at least one elastic engaging member 33 is abutted against the substrate 2. In this embodiment, the at least one elastic engaging member includes two elastic engaging members 33 and biases the flange 32 toward the substrate 2, and each of the two elastic engaging members 33 is a torsion spring. Each of the two elastic engaging members 33 is disposed at an end of the body portion 31 remote from the flange 32 and is abutted against a side of the substrate 2 opposite to the flange 32. As such, it is easy and quick to install/uninstall.

Preferably, the top plate 6 is transparent (no diffusing agent is added), which can save the cost of the top plate 6 and does not affect transmission of the light. A diffusing agent may be added to the cover member 51 to soft the light from the lamp 3.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A lampshade of a recessed light, configured to be connected to a base, the base including a substrate and a lamp, the lamp being disposed on the substrate and including a body portion and a flange, the body portion being disposed on the substrate, the substrate having a diametric dimension larger than a diametric dimension of the flange, the diametric dimension of the flange being larger than a diametric dimension of the body portion, the lampshade including:

a shade body, including a cover member and a top plate covered on the cover member, the top plate including a notch, the notch being open at a periphery of the top plate, the shade body further including a slot, the slot being in communication with the notch, the slot having a width larger than a width of the notch, the diametric dimension of the flange being larger than the width of the notch;

a blocking member, wherein the blocking member includes an upper plate and a lower plate connected to each other, the upper plate is inserted within the notch, and the lower plate is inserted within the slot;

wherein the substrate includes a through hole, the body portion is disposed through the through hole, the diametric dimension of the flange is larger than a diametric dimension of the through hole;

wherein the slot is configured to receive the flange, the notch is configured to receive the body portion, and the top plate is configured to be engaged between the substrate and the flange.

2. The lampshade of claim 1, wherein the cover member includes a recess open toward the top plate, and the recess and the top plate define the slot.

3. The lampshade of claim 1, wherein the upper plate has a width smaller than a width of the lower plate, the lower plate is curved and of a profile matching with a profile of the recess, a closed end of the notch is concave, and an end of the blocking member remote from the notch is convex.

4. The lampshade of claim 3, wherein two sides of the lower plate each include an abutting end abutted against one of two sidewalls of the recess.

5. The lampshade of claim 1, wherein two sides of the upper plate each include a first inclined surface, and two sides of the notch each include a second inclined surface abutted against the first inclined surface.

6. The lampshade of claim 1, wherein the cover member is bowl-shaped, the top plate has an outer diametric dimension equal to an inner diametric dimension of the cover member, and the top plate is detachably engaged within the cover member.

7. The lampshade of claim 6, wherein a plurality of protrusions are disposed on one of the top plate and the cover member, a plurality of concaves are disposed on the other of the top plate and the cover member, and the plurality of protrusions are engaged with the plurality of concaves, respectively.

8. A recessed light, including:

a base, including a substrate and a lamp, the lamp being disposed on the substrate and including a body portion and a flange, the body portion being disposed on the substrate, the substrate having a diametric dimension larger than a diametric dimension of the flange, the diametric dimension of the flange being larger than a diametric dimension of the body portion;

a shade body, including a cover member and a top plate covered on the cover member, the top plate including a notch, the notch being open at a periphery of the top plate, the shade body further including a slot, the slot being in communication with the notch, the slot having a width larger than a width of the notch, the diametric dimension of the flange being larger than the width of the notch;

a blocking member, wherein the blocking member includes an upper plate and a lower plate connected to each other, the upper plate is inserted within the notch, and the lower plate is inserted within the slot;

wherein the substrate includes a through hole, the body portion is disposed through the through hole, the diametric dimension of the flange is larger than a diametric dimension of the through hole;

wherein the slot is configured to receive the flange, the notch is configured to receive the body portion, and the top plate is configured to be engaged between the substrate and the flange.

9. The recessed light of claim 8, wherein the body portion is slidable relative to the through hole, the lamp includes at least one elastic engaging member, the at least one elastic engaging member is abutted against the substrate and biases the flange toward the substrate, the at least one elastic engaging member is a torsion spring, the at least one elastic engaging member is disposed at an end of the body portion remote from the flange and is abutted against a side of the substrate opposite to the flange.

* * * * *